US005788180A

United States Patent [19]

Sallee et al.

[11] Patent Number: 5,788,180

[45] Date of Patent: Aug. 4, 1998

[54] CONTROL SYSTEM FOR GUN AND ARTILLERY PROJECTILES

[76] Inventors: Bradley Sallee, 6713 Shiner, Austin, Tex. 78729; David Schorr, 3810 Frodo Cv., Austin, Tex. 78739

[21] Appl. No.: 756,376

[22] Filed: Nov. 26, 1996

[51] Int. Cl.[6] ..... F41G 7/00

[52] U.S. Cl. ..... 244/3.21; 244/3.15

[58] Field of Search ..... 244/3.16, 3.19, 244/3.15, 3.21, 3.1; 102/529

[56] References Cited

U.S. PATENT DOCUMENTS

| | | | |
|---|---|---|---|
| 3,088,407 | 5/1963 | Gallagher et al. | 244/3.1 |
| 3,202,382 | 8/1965 | Chubb | 244/3.21 |
| 3,235,204 | 2/1966 | Lee | 244/3.21 |
| 3,485,173 | 12/1969 | Morgan | 244/3.1 |
| 4,155,521 | 5/1979 | Evans et al. | 244/3.16 |
| 4,193,567 | 3/1980 | McCarty, Jr. | 244/3.16 |
| 4,347,996 | 9/1982 | Grosso | 244/3.16 |
| 4,431,150 | 2/1984 | Epperson, Jr. | 244/3.21 |
| 4,533,094 | 8/1985 | Geis et al. | 244/3.22 |
| 4,565,340 | 1/1986 | Bains | 244/3.28 |
| 4,577,812 | 3/1986 | Platus | 244/3.21 |
| 4,641,801 | 2/1987 | Lynch, Jr. et al. | 244/3.14 |
| 4,678,142 | 7/1987 | Hirschfeld | 244/3.16 |
| 4,679,748 | 7/1987 | Blomqvist et al. | 244/3.19 |
| 4,690,351 | 9/1987 | Beckerleg et al. | 244/3.16 |
| 4,711,152 | 12/1987 | Fortunko | 89/6.5 |
| 4,728,057 | 3/1988 | Dunne | 244/3.16 |
| 4,796,834 | 1/1989 | Ahlström | 244/3.16 |
| 4,840,328 | 6/1989 | Sundermeyer | 244/3.15 |
| 4,925,130 | 5/1990 | Kranz | 244/3.21 |
| 4,951,901 | 8/1990 | Dunne | 244/3.23 |
| 5,091,730 | 2/1992 | Cardiasmenos et al. | 342/153 |
| 5,102,065 | 4/1992 | Couderc et al. | 244/3.16 |
| 5,131,602 | 7/1992 | Linick | 244/3.19 |
| 5,379,968 | 1/1995 | Grosso | 244/3.21 |
| 5,423,497 | 6/1995 | Ransom | 244/3.21 |
| 5,425,514 | 6/1995 | Grosso | 244/3.22 |
| 5,529,262 | 6/1996 | Horwath | 244/3.16 |

*Primary Examiner*—Charles T. Jordan
*Assistant Examiner*—Theresa M. Wesson
*Attorney, Agent, or Firm*—Liddell, Sapp, Zivley, Hill & LaBoon, L.L.P.

[57] ABSTRACT

A directional control system for ballistic projectiles, including a projectile capable of being fired from a gun, a tracking device within the projectile capable of sensing and identifying a preferred target direction, a moveable mass located within the projectile, an electromagnetic mass-shifting device within the projectile capable of reversibly moving the mass from a first position to a second position whereby the flight path of the projectile is controlled. The directional control system may be used with a projectile which has no externally protruding bodies. The system includes at least one microprocessor programmed to obtain input from the tracking device and to perform calculations to determine movements of the mass. The moveable mass is positioned to shift the momentum vector perpendicular to the central longitudinal spin axis of the projectile when in motion. The mass shifting device preferably includes an electromagnetic driver, which is aligned such that the mass can be moved reversibly from a first position to a second position. The system preferably includes a tracking device including optical fibers for receiving incoming radiation. The system may include a tracking device which is sensitive to radio frequency radiation, and has at least one antenna sensitive to radio frequency radiation. The tracking device may alternatively have at least one infrared detector sensitive to infrared radiation, and preferably has a pyroelectric detector pair.

53 Claims, 9 Drawing Sheets

INITIAL CONDITIONS
(SPIN AXIS ALIGNED WITH MOMENTUM VECTOR)

START PITCH MANEUVER

REVERSE PITCH MANEUVER STARTED

LIFT MANEUVER ENDED
(SPIN AXIS REALIGNED WITH MOMENTUM VECTOR)

CONTROL SYSTEM FOR GUN AND ARTILLERY PROJECTILES

BACKGROUND OF THE INVENTION

1. Field of the Invention

The present invention relates to gun and artillery projectiles, particularly to a system for the guidance and control of the direction of travel of highly spinning gun-fired projectiles, and more particularly to the guidance and control of terminally guided projectiles which are guided in response to laser, infrared, and radar signals.

2. Prior Art Background of the Invention

Various steerable large caliber projectiles have been developed which have on-board homing sensors, remote guidance capability, or preprogrammed trajectories, such as artillery shells, ballistic missile re-entry warheads, and guided self-propelled missiles. Such projectiles have heretofore included on-board gyroscopes, various complicated mass-shifting mechanisms, and remotely controlled extendable fins or vanes to guide and control the flight trajectory of the projectile.

For example, in U.S. Pat. No. 4,431,150, issued Feb. 14, 1984 to Epperson, Jr. and assigned to General Dynamics, discloses a projectile body with a gyroscope mounted therein, and a rotor and supporting mechanism, in which the rotor initially rotates about an axis coincident with the axis of rotation of the in-flight projectile. Initially the rotor mechanism rotates with the projectile, the rotor is then freed to spin independently, and the rotation of the projectile is slowed or stopped. To change direction, the axis of rotation of the spinning rotor is shifted in response to on-board sensors or up-loaded signals. This patent is directed to projectiles such as 5-inch, 8-inch, 105 mm, and 152 mm artillery projectiles.

As another example, U.S. Pat. No. 4,577,812, issued Mar. 25, 1986 to Platus and assigned to The United States of America, discloses a roll control system for a ballistic missile reentry vehicle. This system provides a center of gravity offset in the vehicle and a mass unbalance to create a tilted principal axis of inertia in a plane orthogonal to the center of gravity effect.

As another example, U.S. Pat. No. 4,678,142, issued to Hirschfeld and assigned to The United States of America, discloses a guidance system for a guided projectile fired from a gun having a bore of about 20 mm to 50 mm. In this system, a fraction of a second after firing from a conventional gun, derotating and steering vanes are deployed from the projectile to stop the spin of the projectile. When the spin has stopped, a laser guidance system steers the projectile to the target. While this patent discloses use with a 20 mm projectile, use of fins with the extremely high "g" forces associated with the initial firing of these projectiles is problematic, and the guidance is accomplished only by interaction of the fins with the passing air stream.

Only the last of these systems have been applied to projectiles as small as 20 mm, and it does not use the natural spinning motion of the gun-fired projectile to directly assist in guidance of the projectile. Each of these prior art systems employs a rather complex guidance and control system. None provides a projectile which is simple, cheap, applicable to small caliber projectiles as small as the size range from 50 caliber to 20 mm, not affected by extremely high initial "g" forces, and utilizes the inertia of the spinning projectile to guide the projectile to its target.

SUMMARY OF THE INVENTION

The present invention provides a terminally guided, small-caliber projectile, particularly applicable to projectiles as small as 50 caliber and generally in the size range from 20 mm up to at least 155 mm. The present invention uses a solenoid or voice coil driven mass, mounted within the projectile, to temporarily change the angular momentum vector of the spinning projectile inducing body lift, and thereby steering the projectile towards its target. A change in the angular momentum of the projectile, which results from transfer of momentum to the mass, due to the velocity and radius from the center of gravity of the projectile, causes the projectile to precess. The precession causes the body to change its angle of attack relative to the airstream, creating lift that changes the flight path of the projectile. When the mass reaches the end of its travel and stops, the body is allowed to rotate to the desired position along the cone angle and the mass is set in motion in the opposite direction. By controlling the motion of the mass relative to the cone and rotation angle of the body, energy can be subtracted from the system, inducing coning at the desired position, or added to the system, thus decreasing the cone angle back to zero, again at the desired position.

It is an object of this invention to eliminate the problem of deploying and storing fins on guided artillery projectiles.

It is a further object of this invention to provide an inexpensive guidance and control system which can fit into and function in projectiles or bullets at least as small as 20 mm, and preferably as small as 50 caliber.

It is a further object of this invention to provide an inexpensive guidance and control system useful in artillery projectiles having a diameter up to at least 155 mm, and in larger projectiles.

It is a further object of this invention to provide guidance and control for small projectiles used in relatively short-distance combat situations, in which the projectiles do not include a means of self-propulsion.

These and other objects of the invention will become apparent from the following description.

DETAILED DESCRIPTION OF THE INVENTION

Figure 1:
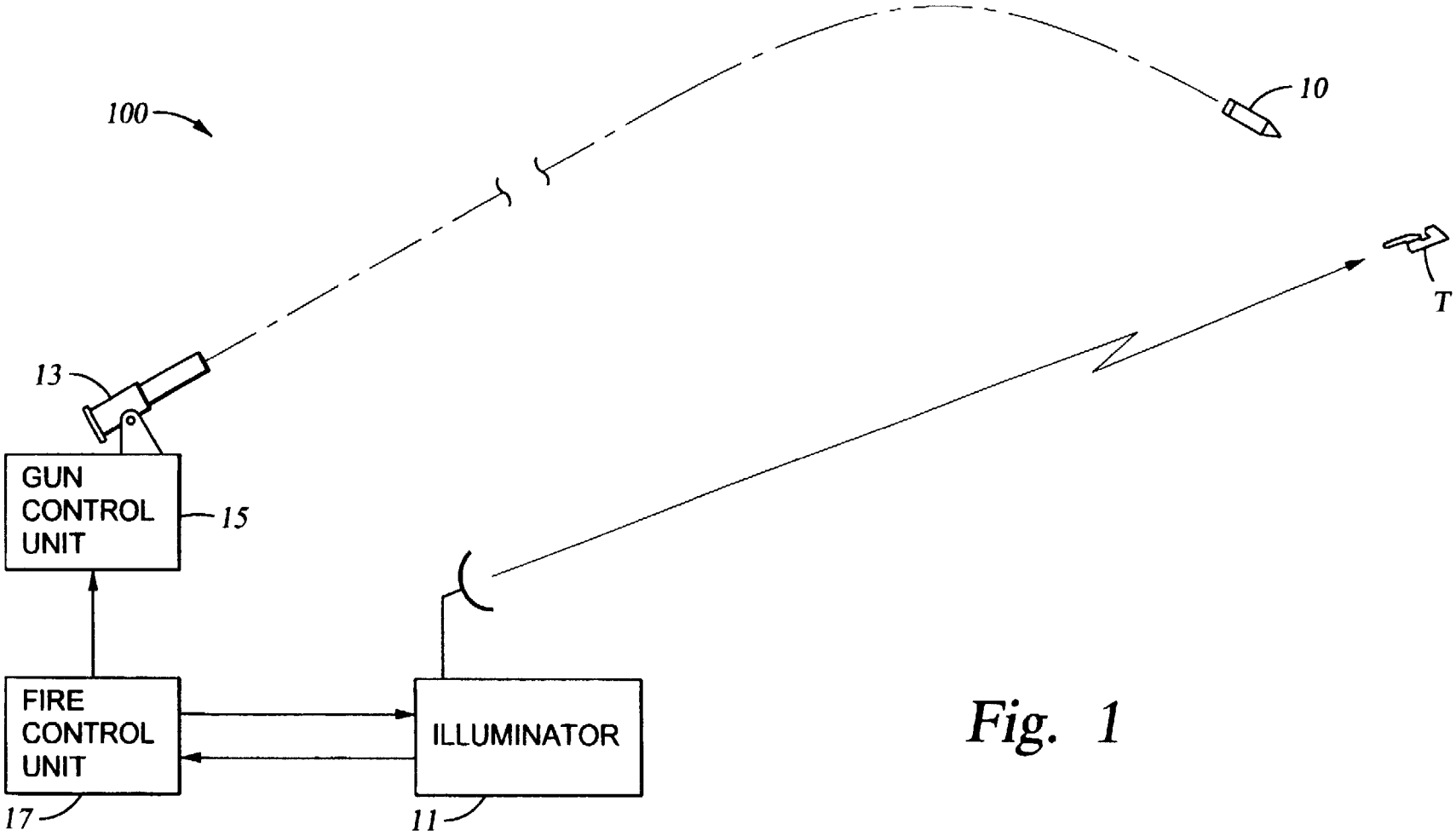
FIG. 1 is a schematic drawing illustrating an exemplary tactical situation showing generally the major components of a defense system with which the guidance and control system of the present invention is employed.

Referring to FIG. 1, a gun control system 100 is shown, including an illuminator 11 for illuminating a target, T, a gun 13, and a gun control unit 15, all of which are controlled by a fire control unit 17. A projectile or bullet 10 is shown to have been fired from the gun 13 toward the target, T, which is being illuminated by radiation from the illuminator 11. The illuminator 11 may be a conventional radar, infrared, laser or other tracking system. It should be apparent that these elements constitute a conventional gun control system, where in a conventional projectile is fired toward the target, T. Such a conventional system in which the projectiles are small, i.e., in the range from 50 caliber to 20 mm, are commonly in use as, e.g., ship-board antiaircraft and anti-missile guns, and on aircraft for air to air combat. Similar systems are used for larger caliber projectiles such as 105 mm and 155 mm projectiles. In such systems, the gun 13 is generally initially aimed in response to signals returned from the illuminator 11. Such conventional systems do not include means for in-flight adjustment of the flight path of the projectile 10.

The present invention provides a guided projectile fired from a gun having a bore as small as about 50 caliber. The invention uses projectiles which include a typical metal cartridge with a conventional propellant onto which the projectile 10 of the invention is fitted, or in the case of larger projectiles, a typical artillery projectile used with a conventional propellant package. The initial aiming and firing of the projectile is therefore conventional. However, unlike conventional projectiles, the trajectory of the fired projectile of the present invention may be changed in order to increase the accuracy and success rate in hitting the target.

In the gun control system of FIG. 1, the illuminator may include one or more of the following: a radar unit, an infrared detector, or a laser source. Preferably a radar unit detects the target, T, providing information to the fire control unit 17, which directs the gun control unit 15 to aim and fire the projectile 10 toward the target. In such a conventional system, once fired, the projectile 10 subsequently cannot be redirected to a better course to its target. The present invention provides a projectile with target homing control in relatively small caliber projectiles or bullets.

Figures 2A, 2B, 2C:
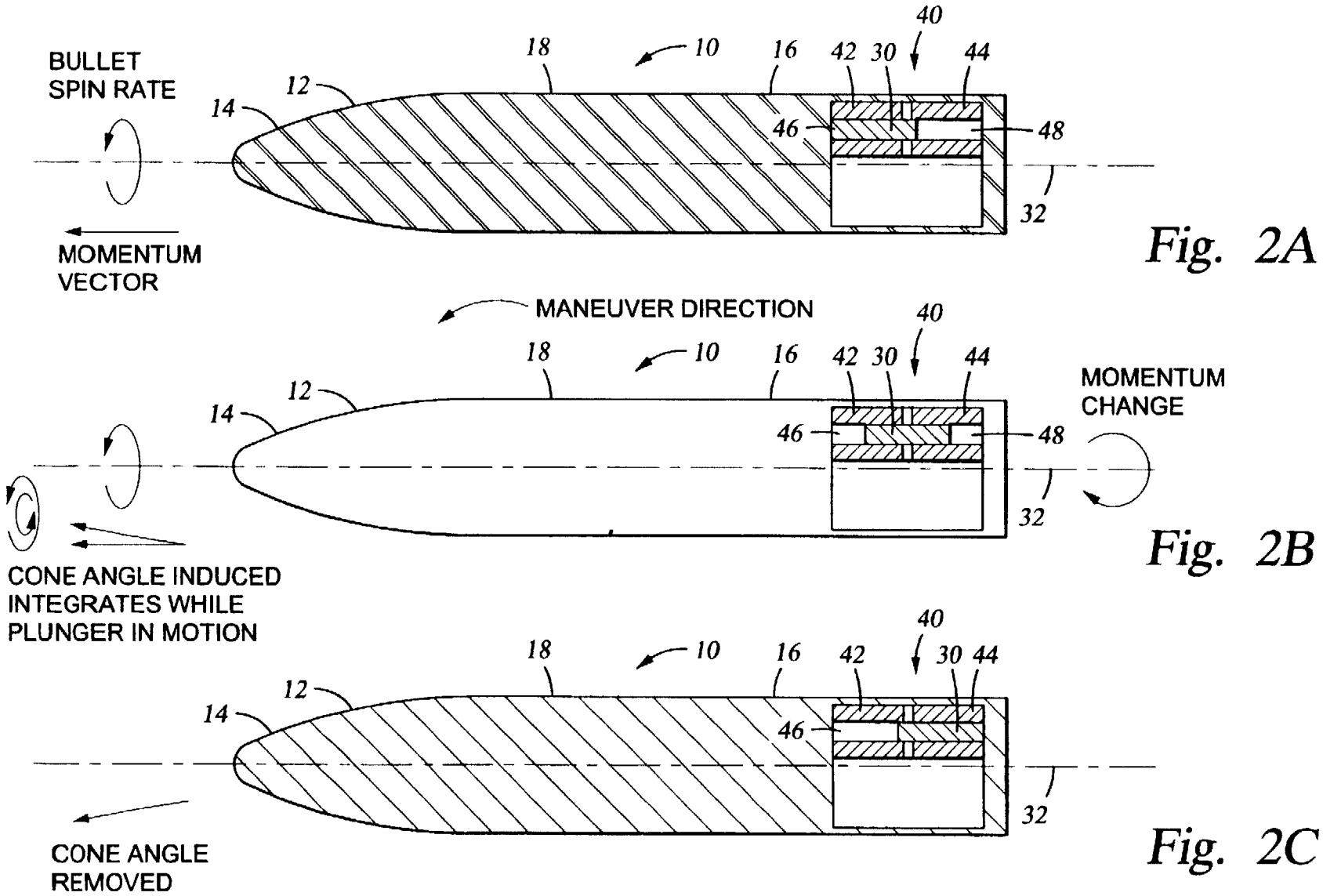
FIG. 2 is a partial cross section of a fired projectile, demonstrating three stages in the movement of the solenoid, in accordance with the invention.

Referring now to FIGS. 2–5, a directional control system for ballistic projectiles, including small caliber bullets as small as 50 caliber, is shown. As best shown in FIG. 2, the bullet 10 is a projectile capable of being fired from a gun, such as the gun 13 in FIG. 1. The projectile preferably has no externally protruding bodies, such as fins, wings, or other objects for affecting the flight path of the projectile 10. Thus, the gross external appearance of the bullet of the present invention is not unlike that of conventional rifle, gun or howitzer bullets or projectiles, in that it has a clean outer surface 18. When the term "externally projecting bodies" is used herein, it should be understood that the projectile has no bodies on its outer surface which either have any substantial interaction with the passing air stream, or have any substantial effect on the trajectory of the projectile flight path.

Continuing with reference to FIGS. 2–5, the bullet 10 of the present invention includes a projectile body 12 having a tapered nose portion 14 and a generally cylindrical rear portion 16. The nose portion may be filled with high explosive material, detonable upon impact, may be essentially a solid metal, or may be filled with a metal such as lead, tungsten or depleted uranium. A conventional cylindrical casing may be affixed to the rear portion of the projectile to provide the initial propulsion for the projectile. Alternatively, the projectile 10 may be fired by means of a package of explosive material loaded separately in the barrel of the gun or artillery piece firing the projectile. In either case, the exploding propellant causes the projectile 10 to begin its travel down the barrel of the gun or artillery piece under tremendous initial acceleration and high velocity. As the projectile 10 travels down the barrel of the gun or artillery piece, a high rate of spin is imparted to the projectile by rifling in the barrel, so that when it emerges from the barrel the projectile is moving forward at a high linear velocity and is rotating at a rate up to 40,000 rpm, or higher.

An outwardly observable difference between the projectile of the present invention and standard prior art bullets is found near the nose portion 14 of the bullet, at which a sensing device, or an opening or aperture to a sensing device, is situated. The sensing device is part of a tracking device 20 within the projectile 10 capable of sensing and identifying a preferred target direction. To wit, the sensing device senses a signal upon which the bullet is to be homed, and transmits a corresponding signal to a guidance and control system. The guidance and control system measures the strength of the signal, and calculates the changes needed to be made to increase the signal strength and causes the changes to be effected.

The guidance and control system may be a unitary, integrated system, or for longer range projectiles it may more preferably comprise two systems, one a tracking or guidance system and the other a flight control system. More preferably, the guidance and control system of the present invention includes not only both a separate guidance system and flight control system, but also separate microprocessors dedicated to each system. It is contemplated that the number of inputs and variables to be measured and analyzed in the time available for performing the guidance function will best be accomplished using a dedicated tracking processor. Likewise, in order to properly control the flight of the projectile by causing the movement of mass within the projectile at the appropriate time in response to signals from the guidance system, it is preferred that the flight control system use a dedicated flight control processor.

The directional control system of the present invention may have one or more of several different types of tracking or navigational devices, based on the target-identifying radiation available to the system. The tracking devices provide their information to the guidance system for processing. Several embodiments of the tracking device may be used. The invention is not, of course, to be limited to a specific type of tracking device. In addition to the tracking devices described in detail below, the tracking or navigational device used in the projectiles of the invention may comprise inertial navigational systems and global positioning systems based on satellite data.

Figure 4A:
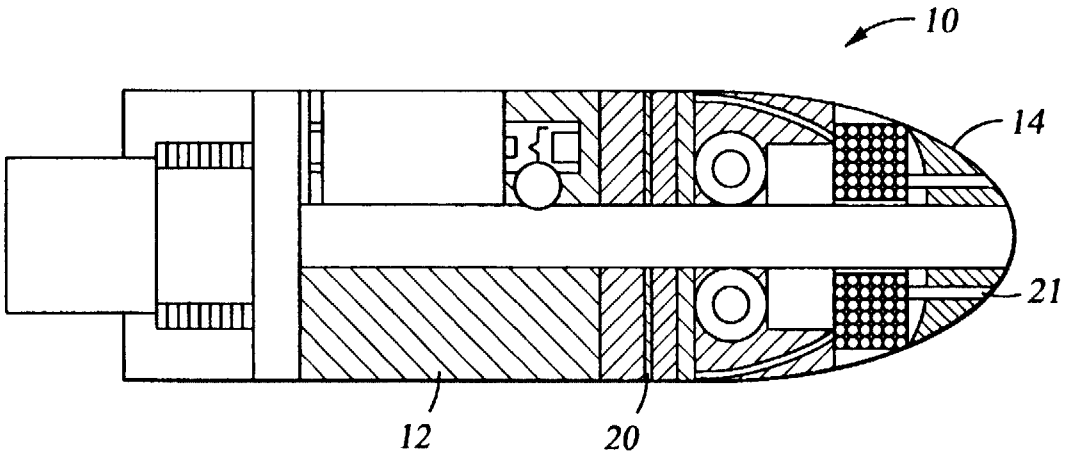
FIG. 4 is a cross section of two embodiments of the projectile of the invention, each showing schematically optical fibers as the radiation receiving device.
Figure 4B:
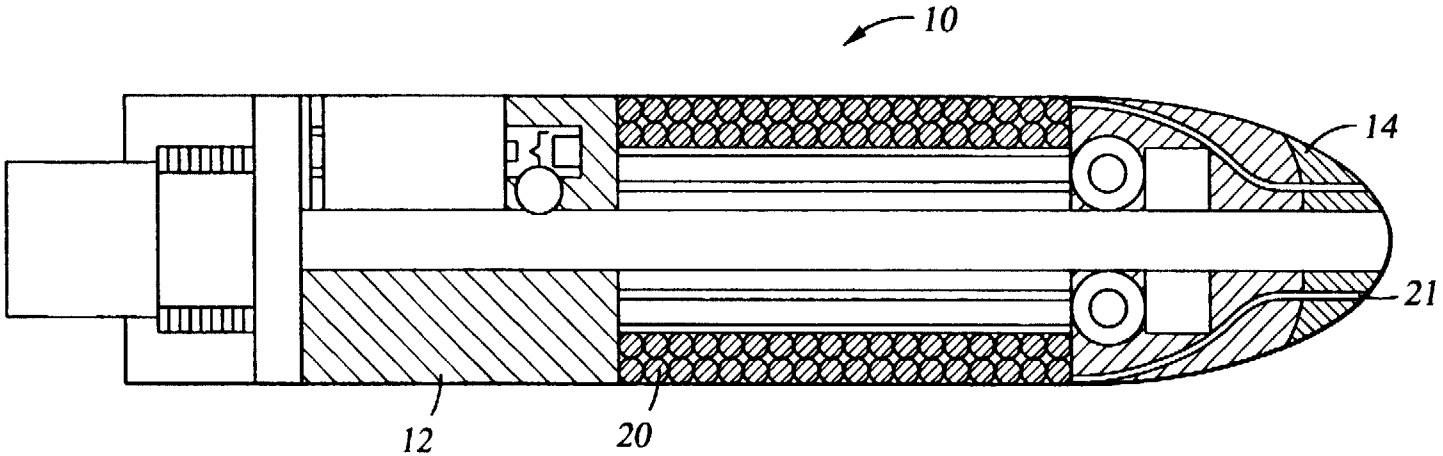

In a first embodiment, the tracking device 20 comprises a plurality of fiber optic sensors 21 arrayed around the nose 14 of the projectile, as shown in FIG. 4. At least two optical fibers are arrayed around the nose of the projectile. Preferably, a larger number of optical fibers are employed. The number of fibers which can practicably be used may be limited by the caliber of the projectile in small projectiles. Preferably at least two optical fibers are used in the projectile 10. The optical fiber detection system may be a system such as that disclosed in commonly assigned U.S. Pat. No. 5,225,894, to 19 Nicholson, et al., and/or commonly assigned U.S. application Ser. No. 08/440,637, filed May 15, 1995, now U.S. Pat. No. 5,619,332, both of which are hereby incorporated herein by reference. These references disclose an optical fiber guidance system which preferably obtains optical signals reflected from a laser-illuminated target, and calculates a trajectory to the target based on analysis of various features of the optical signals. In this first embodiment of the present invention, the inputs from the optical fibers 21 are separated and compared to allow the target position and trajectory to be interpolated quite accurately by the tracking microprocessor 22. The guidance microprocessor can then calculate the timing of movement of the mass 30 required to adjust the direction of travel of the bullet 10.

Figure 3B:
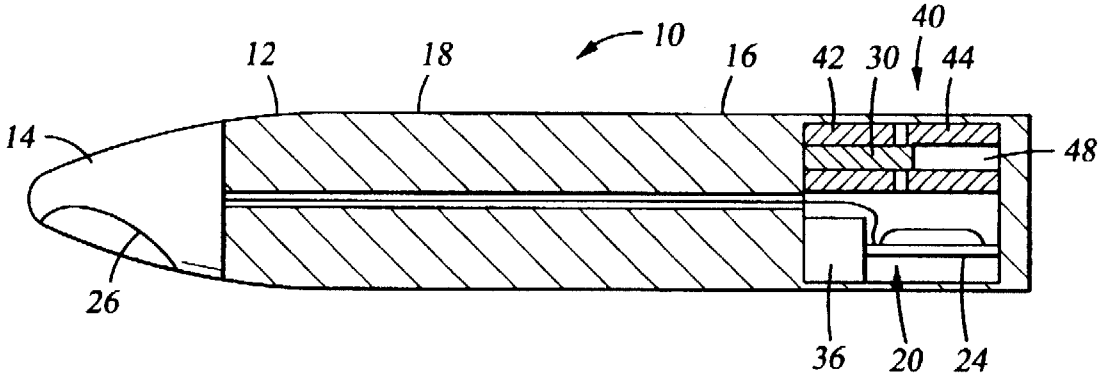
FIG. 3 is a partial cross section of two embodiments of the projectile of the invention, each showing schematically a detection system in accordance with the invention.
Figure 3C:
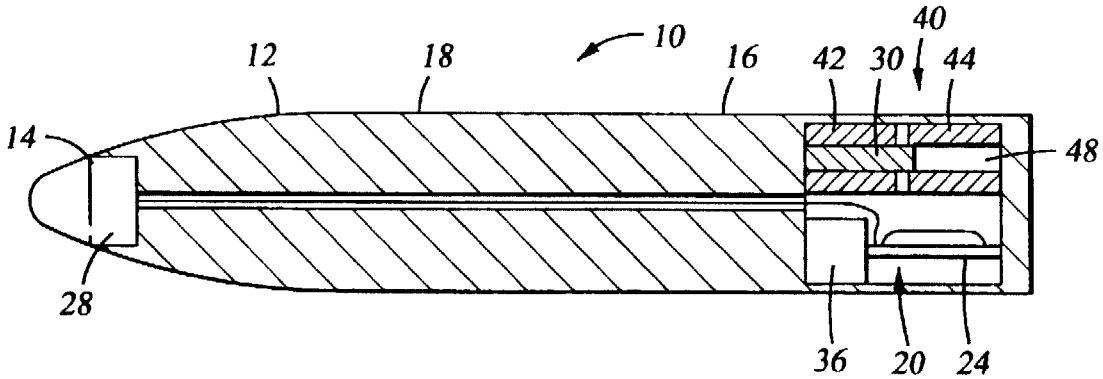
Figure 3A:
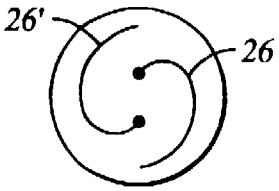

In a second embodiment, shown in FIG. 3, the tracking device 20 is sensitive to radio frequency radiation, and accordingly includes an antenna sensitive to radio frequency radiation. Preferably in this embodiment the tracking device includes two antennae, 26, 26', sensitive to radio frequency radiation, and uses the input of both to obtain information as to the direction to the target. The initial source of the radio frequency radiation is preferably from a radar unit operating from the same platform as the gun firing the bullet or projectile of the invention. The radar signal from such a source bathes the target in radio frequency radiation, and the echoed radar signal both is used to initially aim the gun 13 toward the target and is detected by the antennae mounted on the nose of the bullet or projectile for input to the detector 20. The detector 20 outputs information based on the difference between the two antenna inputs to the tracking microprocessor 24, from which the flight control microprocessor can calculate the timing of movements of the mass 30 required to adjust the direction of travel of the bullet 10.

In a third embodiment, as shown in FIG. 3, the directional control system includes a tracking device 20 which is sensitive to infrared radiation, and includes at least one infrared detector 28 sensitive to infrared radiation. Preferably the infrared detector is a pyroelectric detector pair which provides two inputs which are separately measurable. The source of the infrared radiation may be a laser directed onto the target, from the platform on which the gun firing the bullet or projectile is located, or may be other infrared radiation emanating from the target T. Infrared radiation reflected or emitted from the target is detected by the infrared detector 28 in the bullet or projectile 10. Because the paired infrared detector provides two separate signals, it provides directionally significant information to the tracking microprocessor, which is indicative of the orientation of the bullet with regard to the target. This output provides information from which the flight control microprocessor can calculate the timing of movements of the mass 30, in order to adjust direction of travel of the bullet 10.

Thus, in the latter two embodiments, the detectors are paired, so that two signals are obtained which can be compared. When signals received simultaneously from the two detectors are electronically compared in the microprocessor, any imbalance represents the deviation from a track directly pointing on the source of the detected radiation, i.e., the target, T in FIG. 1. The degree of deviation can be used by the flight control microprocessor to calculate the position of and trajectory to the target.

In all embodiments, the information obtained from the tracking device is preferably combined with information from other sensors to allow the tracking microprocessor to calculate to a high degree of accuracy the position of the projectile with relation to the earth, the air stream, and the target and all such information is used by the flight control microprocessor to determine movement of the moveable mass. The other sensors which may be included within the projectile are preferably off-axis accelerometers to detect spin rate, cone angle, gravity vector and angle-to-earth around the spin axis and pressure sensors to determine the slip angle relative to the air stream, Mach number and static pressure. Some or all of these other sensors may omitted from the smaller caliber projectiles.

Each of the three preceding embodiments may be applicable to at least two further groups of embodiments, based upon the type of moving mass device used to alter the angular momentum and thus the trajectory of the projectile. In the first of the mass-moving embodiments shown in FIGS. 2–4, in order to effect changes in the trajectory of the smaller projectiles such as 50 caliber and 20 mm projectiles, a moveable mass 30 is located within the bullet or projectile 10. Movements of the mass 30 during flight of the bullet or projectile after it has been fired alters the trajectory of the bullet. The moveable mass 30 is positioned off the central longitudinal axis 32 of the bullet or projectile 10, and is therefore positioned off the axis of rotation of the bullet. The mass then simulates a section of a flywheel pivoted about a point on the longitudinal axis of the projectile perpendicular to the spin axis of the projectile.

The central longitudinal axis 32 is generally identical and collinear with the axis of rotation. The bullet or projectile 10 fired from a gun (not shown) as described herein is rotating at a very high rate, in the range up to at least about 40,000 revolutions per minute (rpm). The mass 30 can thus be moved from one position to the other, acting as a flywheel rotating a short distance, thus increasing or decreasing the cone angle of the spinning projectile 10. The body lift induced by the cone angle through which the projectile moves creates the desired changes in the trajectory of the projectile 10.

In the example shown in FIGS. 2 and 3, the mass and solenoids are oriented in and move the mass in a direction parallel to the longitudinal spin axis of the projectile. The mass and solenoids may be oriented orthogonal to the longitudinal spin axis. Multiple sets of mass and solenoids may be present in one projectile, and if such multiple mass and solenoid units are present, they may be aligned orthogonally to each other as well as to the longitudinal spin axis.

The mass 30 is moved within the projectile 10 by means of a solenoid-actuated mass-shifting device disposed within the projectile. The mass shifting device 40 is preferably a dual solenoid with a ferromagnetic mass. The mass shifting device 40 is preferably two solenoids, 42, 44 arranged end-to-end, with the mass 30 in the cavity 46, 48 of one solenoid or the other at all times. In this embodiment, the mass 30 includes a ferromagnetic portion which can be influenced by the magnetic action of two electro-magnetic solenoids. The mass-shifting device 40 is capable of reversibly moving the mass 30 back and forth from a first position in the cavity 46 of one solenoid 42 to a second position in the cavity 48 of a second solenoid 44. Thus, the mass 30 can be reversibly moved between the two solenoids, from the first position to the second position. Preferably the solenoid pair moves the mass in response to a pulse code modulated signal from the flight control microprocessor to allow mass velocity control.

The following description of a second embodiment of the moveable mass particularly applies to larger projectiles, such as artillery projectiles, in the size range up to at least 155 mm, and is best understood with reference to FIGS. 6 through 9. This embodiment may be referred to generally as the moving plate embodiment. This embodiment includes the general features described herein, relating to the guidance and control system, the tracking devices, and the components described below, including the microprocessor, battery, state sensors, and other features described.

In larger projectiles, in order to effect changes in the trajectory of the projectile, a moveable mass 50 is located within the bullet or projectile 60. Like the smaller bullets or projectiles, the movement of the mass during flight causes changes in the trajectory of the projectile. Thus, movements of a mass or swash plate 50 during flight of the projectile 60 after it has been fired alter the trajectory of the projectile. However, unlike the moveable mass 30 in the smaller bullet or projectile 10, the moveable mass or swash plate 50 in the projectile embodiment 60 is not positioned off the central longitudinal axis 52 of the projectile 60. Rather, the center of gravity of the moveable mass is aligned with the central longitudinal axis 52 of the projectile 60 and is therefore positioned on the axis of rotation of the projectile. This arrangement is preferred in larger projectiles due to the greatly increased centrifugal forces in a rapidly rotating projectile having a radius of 70 mm or more, as compared to a bullet having a radius of 10 mm or less. The centrifugal forces resulting from the very high rotation rate, in larger projectiles, make it increasingly difficult to move a mass located off the central longitudinal axis, which would be easily moveable at rest or lower rotational velocity, or in a smaller diameter projectile. For this reason, the moveable mass 50 is preferably a projectile, flattened plate-shaped object or disk, preferably made of glass reinforced plastic which is centrally mounted to provide a radially balanced distribution of mass in the projectile. Most preferably, the moveable mass 50 has a uniformly distributed mass as large as the power capabilities of the projectile are capable of driving at the required frequency, and a diameter commensurate with the diameter of the projectile in which it is disposed. The movable mass, much like the single mass in the smaller projectiles, acts as a section or a series of flywheels all rotatable perpendicular to the longitudinal spin axis of the projectile.

In the example shown in FIGS. 6 through 9, the central longitudinal axis 52 is generally identical and collinear with the axis of rotation of the projectile. The projectile 60 fired from a gun or artillery piece (not shown) as described herein is rotating at a very high rate, in the range up to at least about 40,000 revolutions per minute (rpm). The mass 50 can be moved from one position to the other, and in so doing it acts as a flywheel rotating a short distance, thus increasing or decreasing the cone angle of the spinning projectile 60. The cone angle induces body lift creating the desired changes in the trajectory of the projectile 60.

Figure 7:
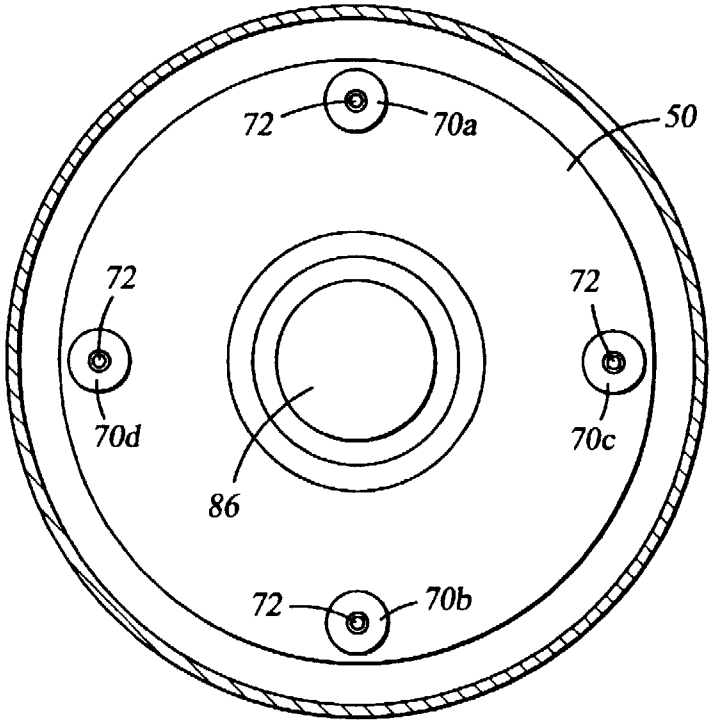
FIG. 7 is a cross-section through line 7—7 of FIG. 6, showing the most preferred arrangement of solenoids and plungers and the central ball pivot.
Figure 6:
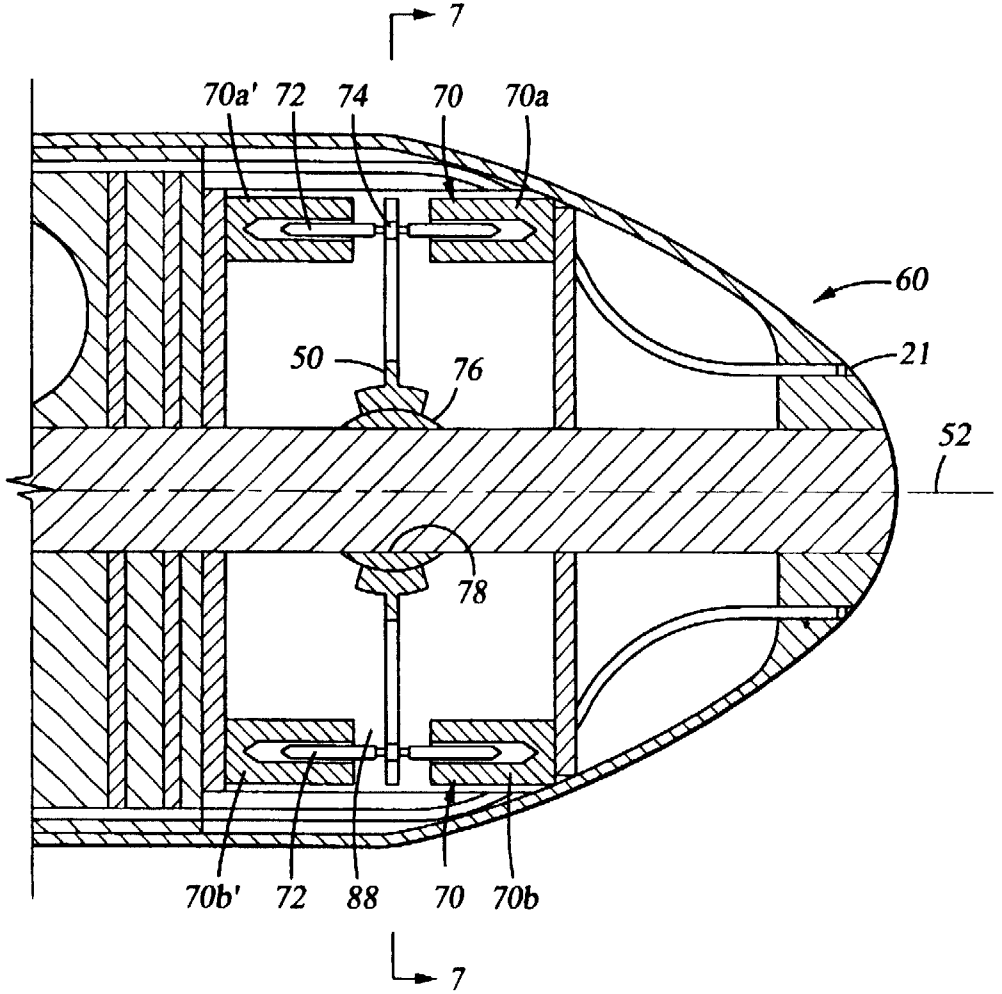
FIG. 6 is a partial cross-section of a projectile according to one preferred embodiment of the invention, comprising solenoid-activated plungers attached to a swash plate as the moving mass.

The mass or swash plate 50 is moved within the projectile 60 by means of a solenoid-like actuating mass-shifting device disposed within the projectile. In the artillery projectile embodiment, two different mass shifting devices may be used. One embodiment, referred to as the solenoid plate and shown in FIGS. 6 and 7, preferably uses a solenoid 70 working together with a ferromagnetic plunger 72 to move the swash plate 50. The mass shifting device 70 preferably comprises four dual solenoids 70*a*, 70*b*, 70*c*, and 70*d*, each dual solenoid oppositely disposed end-to-end, to provide back and forth movement of the plungers 72 and the swash plate 50, from a first position to a second position. Preferably, one ferromagnetic plunger 72 is inserted partially into each solenoid 70. Each plunger 72 is attached to the swash plate 50, at a plunger ball pivot 74. Preferably, there are eight solenoids and eight plungers, one on either side of the swash plate 50, disposed every 90 degrees in the projectile, as shown in FIG. 7. The mass 50 is supported on a ball pivot 76 in a cavity 78. In this embodiment, the solenoids 70 preferably are electro-magnets. In this embodiment, the plungers 72 preferably are ferromagnetic and so can be influenced by the magnetic action of the electromagnetic solenoids. Although the preferred number of solenoids and plunger assemblies is eight, the number actually used may be any number of solenoids which can be regularly radially arrayed in a position in the projectile, preferably but not necessarily in pairs mounted on opposite sides of the moveable swash plate 50. This is preferred for achieving weight balance in the projectile and to facilitate movement of the swash plate 50 at the high revolution rate attained by such projectiles.

Figure 9:
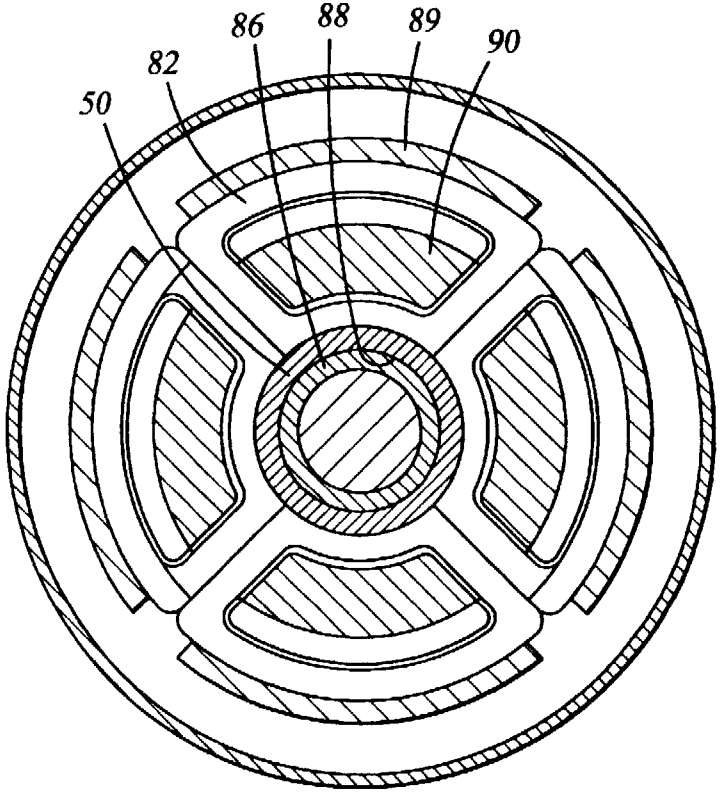
FIG. 9 is a cross-section through line 9—9 of FIG. 8, showing the most preferred arrangement of rare earth magnets and moving coils and the central ball pivot.
Figure 8:
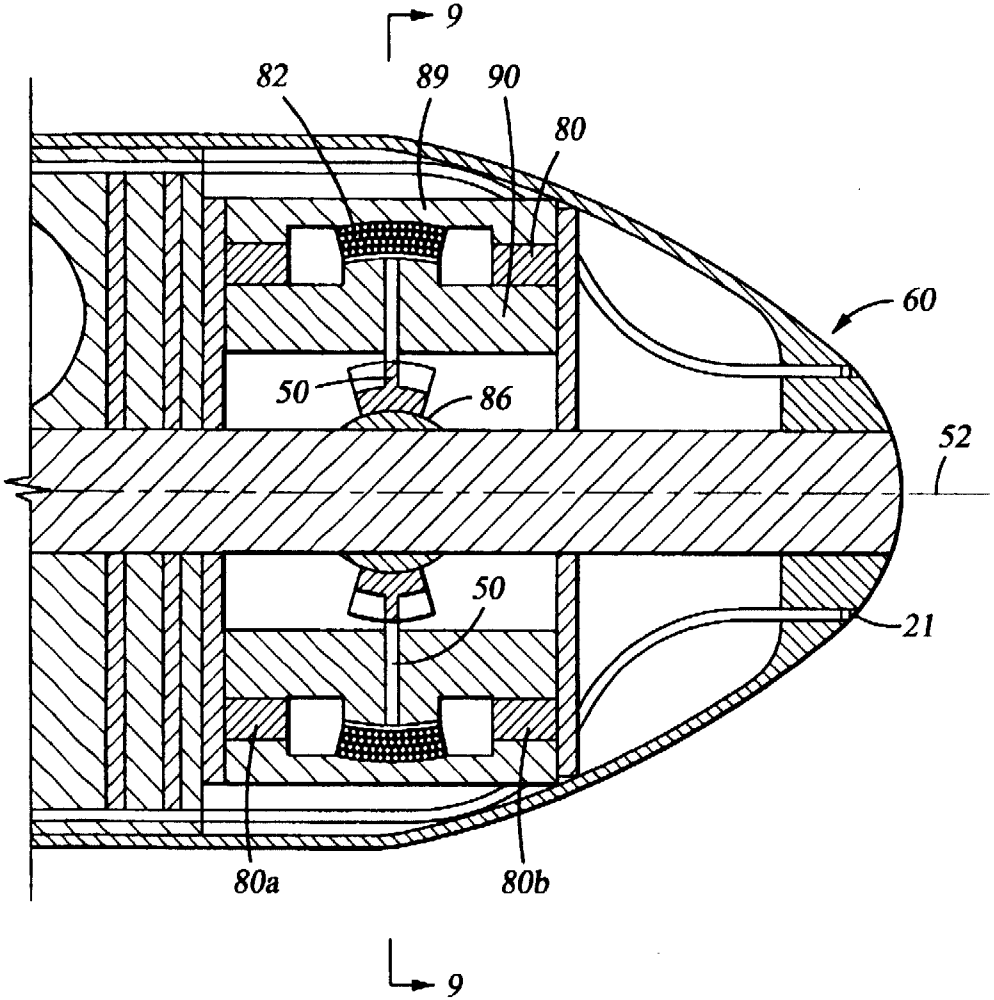
FIG. 8 is a partial cross section of a projectile according to another preferred embodiment of the invention, comprising a rare earth magnet and moving coil (voice coil actuator) for movement of a swash plate or moving mass.

The second embodiment of the mass shifting device, referred to as the voice coil or moving coil embodiment and shown in FIGS. 8 and 9, most preferably uses a rare earth magnet 80 working together with an electromagnetic coil 82. The magnet 80 does not have to be a rare earth magnet, but the rare earth magnet is preferred. Other magnetic materials may be used, but are not optimal. The mass shifting device 80 preferably comprises two cylindrical rare earth magnets 80*a* and 80*b*, the magnets arranged opposite each other. Four electromagnetic coils 82 are attached perpendicular to each other on the swash plate 50. The outer radius of each coil 82 is inserted into the combined field of the two magnets 80*a* and 80*b*. The field lines of the magnets 80*a* and 80*b* are concentrated by magnetic field concentrators 89 and 90 and directed through the ends of the coils 82. The coil current and field lines are arranged so that the coil generates force in opposite directions, creating a torque on the swash plate 50, as shown in FIG. 9. This forms four radially disposed moving coil actuators on the plate 50 which can act in opposite directions by reversing the current flow direction in the coils 82. The mass 50 is supported on a ball pivot 86 in a cavity 88. In this embodiment, the rare earth magnets 80 preferably are magnets made from known rare-earth magnetic materials, such as neodymium-iron boron or samarium-cobalt. In this embodiment, the coils 82 preferably are electromagnetic coils, made of copper wire and so can be influenced by the rare earth magnets. The preferred number of solenoid and plunger pairs is four or four moving coil actuators. The number actually used may be any number of solenoids which can be regularly radially arrayed in a position in the projectile, preferably but not necessarily in pairs mounted on opposite sides of the swash plate 50. This is preferred for achieving weight balance in the projectile and to facilitate movement of the swash plate 50 at the high revolution rate attained by such projectiles.

Both embodiments of the moving swash plate work in essentially the same way. Interactions between the electromagnetic device (solenoid or coil) and the magnetic device (plunger or magnet). The solenoid device is monodirectional and requires a pair of solenoids for bidirectional movement, while the coil is bidirectional requiring only one device. Both devices cause the moving plate 50 to tilt back and forth about the plate ball pivot 74 or 86. The moving plate device reversibly tilts the swash plate 50 back and forth from a first, resting position to a second activated position. Preferably the moving plate moves in response to a signal originating from the guidance system and sent as a pulse code modulated signal from the flight-control processor, allowing a continuously variable pitch rate. Thus, the mass-shifting device is capable of reversibly moving the swash plate 50 back and forth from a first position in the cavity of one side of the electromagnet-magnet pair to a second position in the cavity of the other side of the electromagnet-magnet pair in the case of the solenoid drivers, or by reversing current from one stop to the other, using the coil-magnet drivers. Thus, the swash plate 50 can be reversibly moved between the two positions using electromagnet-magnet drivers, from the first position to the second position. Preferably the electromagnet-magnet pair moves the mass in response to a pulse code modulated signal from the flight control processor allowing continuously variable pitch velocity.

Figure 5G:
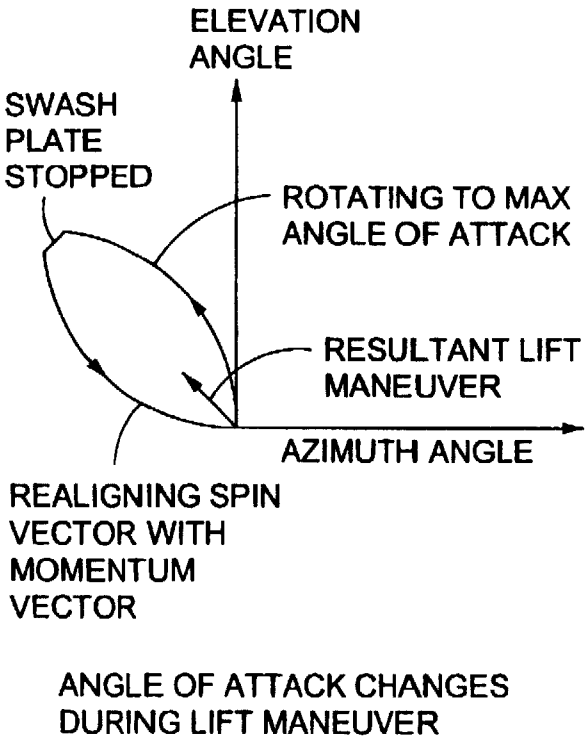
FIGS. 5A through 5G are schematic perspective views of a projectile in accordance with the invention, demonstrating the effect of movement of the mass on the momentum vector, for an embodiment using a swash plate as the moving mass.
Figure 5A:
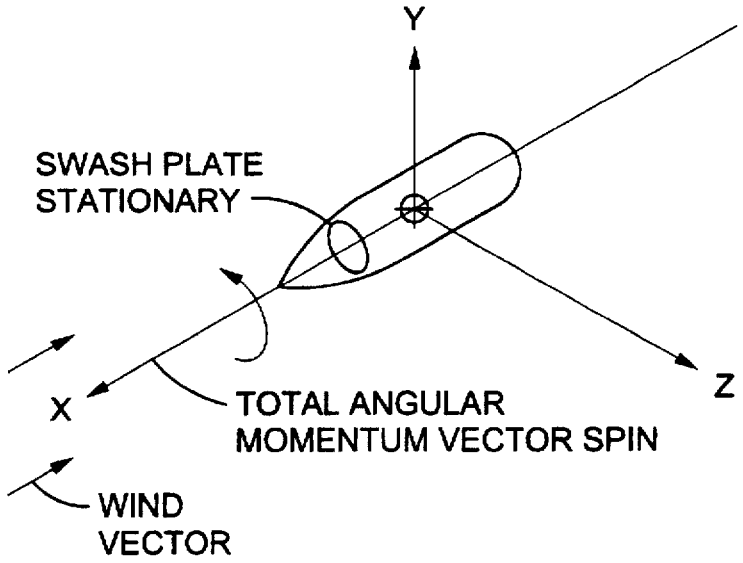
Figure 5B:
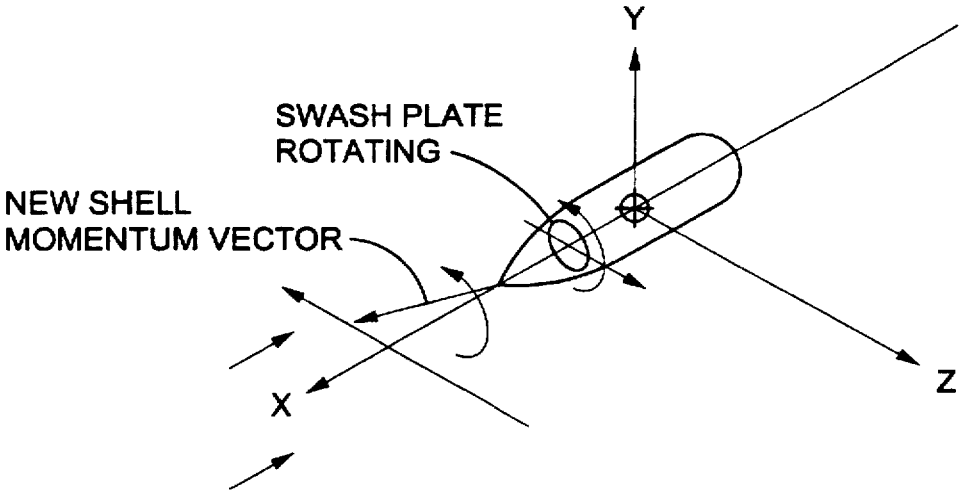
Figure 5C:
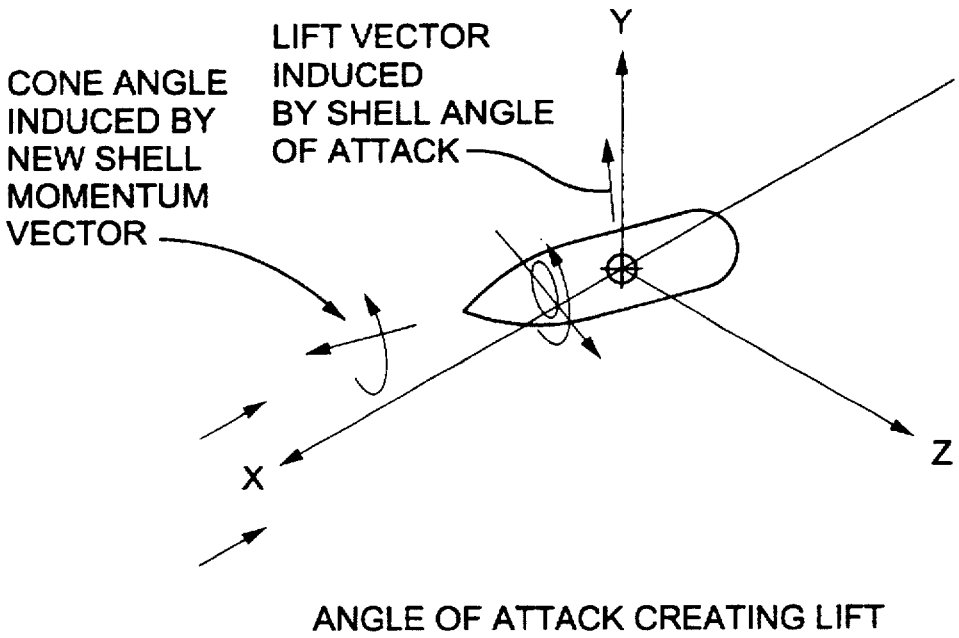
Figure 5D:
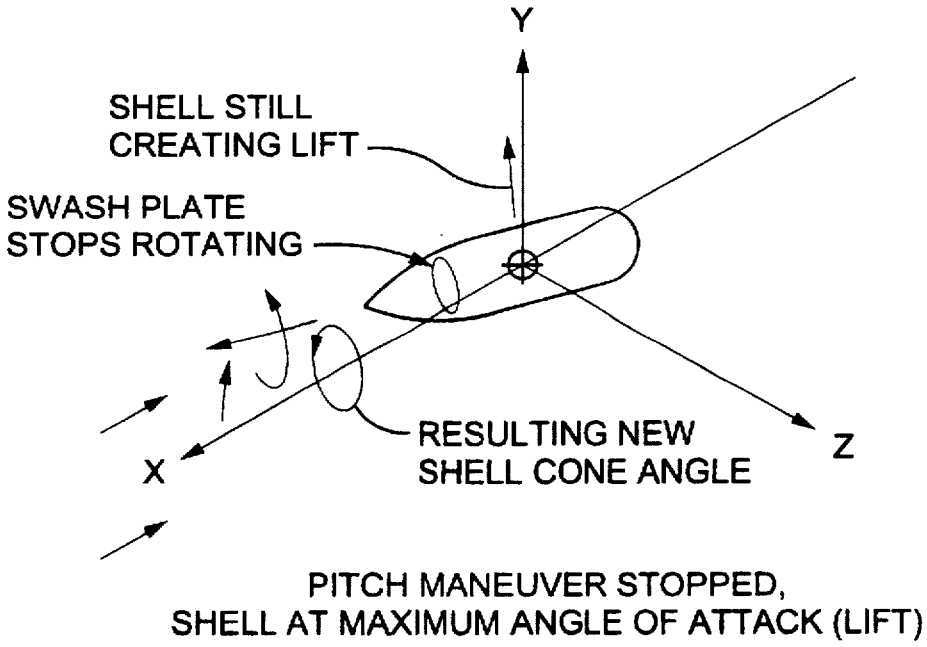
Figure 5E:
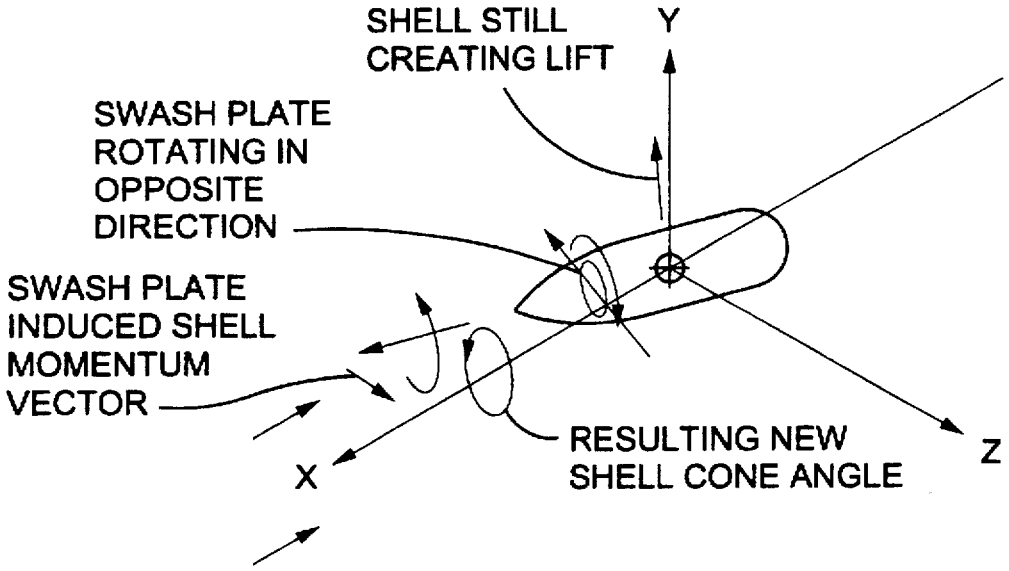
Figure 5F:
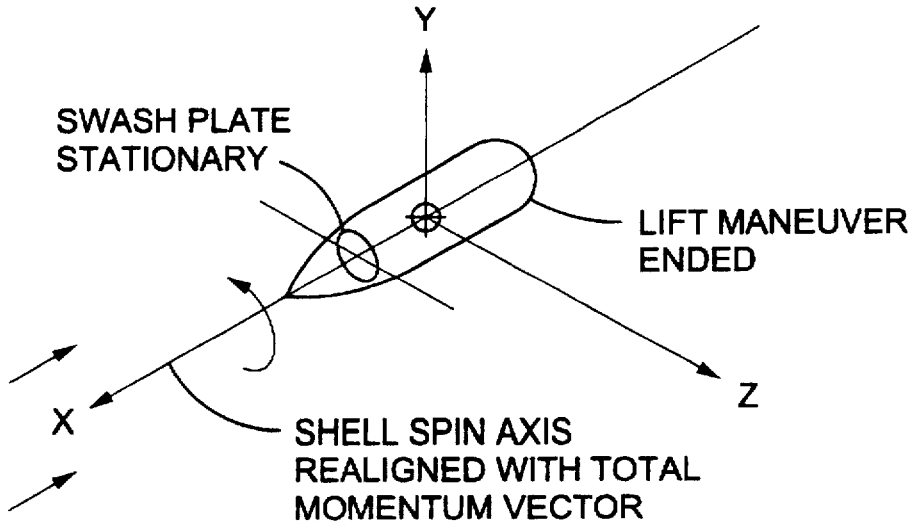

The following description of a maneuver and the effect thereof is best understood with reference to FIGS. 5A through 5G. When the projectile has been fired and is in flight toward its target, and prior to the maneuver, the projectile is rapidly spinning on its longitudinal axis, is moving parallel to and substantially on its longitudinal axis, and is most preferably not precessing as shown in FIG. 5A. The projectile may be considered to be moving at zero angle of attack, directly into the "wind" created by its own movement. When a maneuver is to be performed, a signal is sent from the guidance system to the control system on the projectile to move the mass. See FIG. 5B. The movement of the mass shifts angular momentum to the mass causing the projectile to precess, or form a cone angle. See FIG. 5C. Lift is generated as the body follows the precession cone. The central axis of the cone swept out by the projectile's precession is aligned to the original momentum vector, minus the momentum shifted to the moving mass. This creates an angle of the projectile that is rapidly changing relative to the "wind" direction. This change in angle relative to the wind causes lift on the body causing a maneuver in the lift direction. When the mass stops moving, shown in FIG. 5D, the projectile momentum vector again becomes aligned parallel to the original spin axis, creating a new precession angle. The body is still at an angle of attack relative to the wind, and the lift maneuver continues. At a selected time, when the rotation has continued until the projectile is pointing in the desired new direction, the swash plate is moved back to its original position, as shown in FIG. 5E. The lift maneuver continues during this movement decreasing to zero at its end. This movement of the swash plate, being equal and opposite the original movement (shown in FIG. 5B), cancels the earlier movement, ends the precession, and returns the cone angle to zero, as shown in FIG. 5F. At the instant the precession stops, the projectile longitudinal spin axis is again aligned with the momentum vector and the projectile has made a turning maneuver whose magnitude is determined by the integral of the lift vs. time and the mass of the projectile. At this point, the spin axis is realigned with the momentum vector, but the direction of flight has been altered to a selected degree. FIG. 5G illustrates the change in orientation of the spin axis of the projectile before, during and after the maneuver of the projectile according to the invention. From a top level the system (plate+body) total momentum vector remains the same, but energy is subtracted to increase the cone angle and added to decrease it, all by manipulating the swash plate. Precise selection of the times of moving the mass allows precise selection of the new direction of the flight path of the projectile. The selection of the times for moving the mass is controlled by the on-board flight control microprocessor. This selection is based on the input from the tracking microprocessor, which in turn is based on the inputs from the various sensors and target detectors.

The system preferably includes the other sensors mentioned above, particularly at least one accelerometer and at least one state sensor. The accelerometers obtain information as to the position and orientation, relative to the earth, of the spinning projectile and the cone angle. Preferably, these accelerometers are two in number, one located off the longitudinal spin axis of the projectile, the other on the longitudinal spin axis, and are inexpensive machined silicon integrated circuit devices. The accelerometers provide input on the spin rate, cross wind or gravity vector, and cone angle. One of the accelerometers is preferably mounted to sense the radial acceleration and is offset from the spin axis. The second accelerometer is preferably mounted on the spin axis, perpendicular to the first accelerometer, and perpendicular to the spin axis. This accelerometer provides input for the gravity or cross wind drag vector, and the cone angle. When the spin rate from the first accelerometer is known, the gravity or cross wind drag vector can be calculated, and the angle of the projectile relative to the ground can be obtained. The accuracy of this determination is limited by the range of the accelerometer, which generally is wide.

The state sensors sense the pressure of the surrounding air stream at various points around the spinning, in-flight projectile. These pressure sensors provide information for determination of the cross wind velocity and direction, the angle of attack of the projectile with relation to the cross wind. When this information derived from the measured data is combined with a parametric curve fit of measured data versus mach number and angle of attack, the angle between the projectile longitudinal axis and the projectile's velocity vector can be obtained.

The system further includes a microprocessor 24 programmed to obtain input from the tracking device 20 and to perform calculations to determine timing and frequency for movements of the mass 30. Through the use of this system, the projectile essentially steers itself to a preferred target. As has been disclosed above, the system preferably includes two microprocessors, a tracking microprocessor, dedicated to the guidance system, and a flight control microprocessor, dedicated to the flight control system. While this is the preferred embodiment, the system may also work with a single microprocessor. It is understood that reference herein to the microprocessor encompasses both the preferred embodiment with its two microprocessors and other embodiments such as one with a single microprocessor.

As shown in FIG. 3, the projectile 10 includes a battery 36, which provides power to the system, including the microprocessor 24, the tracking device 20, and the solenoids 42, 44. The battery is preferably a thermal battery, i.e., a battery having an electrolyte which is inactive at ambient temperatures, and which must be raised to a high temperature and melted before it becomes active. Preferably, the battery is a fast rise time thermal battery. The battery preferably can be activated in less than 50 milliseconds. Alternatively, the battery may be a small, powerful battery with a long storage life, such as a lithium battery, or other similar battery.

To summarize the disclosure of the present invention, a directional control system for ballistic projectiles is disclosed, including a projectile capable of being fired from a conventional gun. The projectile includes a tracking device capable of sensing and identifying a preferred target direction. The projectile further includes a moveable mass located within the projectile and at least one solenoid- or moving coil-actuated mass-shifting device within the projectile capable of reversibly moving the moveable mass from a first position to a second position whereby the flight path of the projectile is adjusted to steer the projectile to a preferred target. The system includes at least one microprocessor programmed to receive input from the tracking device and to perform calculations to determine movements of the mass. The projectile preferably has no externally protruding bodies. The moveable mass is positioned such that shifting it creates an angular momentum shift perpendicular to the central longitudinal axis of the projectile. The mass shifting device preferably includes two solenoids or a moving coil driver, which are aligned such that the mass reversibly can be moved from a first position to a second position. The moveable mass may comprise a plunger in a solenoid, or it may comprise a ball pivot-mounted swash plate. The moveable mass may be mounted off-axis in one embodiment or on the longitudinal axis of the projectile for the swash plate embodiments. The system includes a tracking device for providing target direction information to the microprocessor. In the preferred embodiment, the tracking device includes a plurality of optical fibers for receiving radiation emanating from the target. In a second embodiment, the tracking device is sensitive to radio frequency radiation, and has at least one antenna sensitive to radio frequency radiation emanating from the target, but preferably has two such antennae. In a third embodiment, the tracking device is sensitive to infrared radiation emanating from the target, and has at least one infrared detector sensitive to infrared radiation, and preferably has a pyroelectric detector pair and is directionally sensitive.

Having described the invention above, various modifications of the techniques, procedures, material, and equipment will be apparent to those in the art. It is intended that all such variations within the scope and spirit of the appended claims be embraced thereby.

What is claimed is:

1. A directional control system for spinning ballistic projectiles, comprising:

a projectile, the projectile having a rotation axis and rotating about the rotation axis at a rotation rate;

a device within the projectile capable of sensing and identifying a preferred target direction relative to the projectile;

a moveable mass located within the projectile; and at least one electromagnet-magnet driver mass-shifting device within the projectile capable of reversibly moving the mass from a first position to a second position; the moveable mass rotationally fixed relative to the projectile when engaged in either the first position or the second position;

whereby the flight path of the projectile is controlled for movement toward a target.

2. A directional control system as claimed in claim 1, wherein the projectile has no externally protruding bodies.

3. A directional control system as claimed in claim 1, wherein the system includes at least one microprocessor programmed to receive input from the sensing device and to perform calculations to determine movements of the mass.

4. A directional control system as claimed in claim 3, wherein the system includes two microprocessors.

5. A directional control system as claimed in claim 3, wherein the system includes at least one accelerometer within the projectile, for providing input to the microprocessor.

6. A directional control system as claimed in claim 5, wherein the system includes two accelerometers within the projectile.

7. A directional control system as claimed in claim 3, wherein the system includes at least one pressure sensor within the projectile, for providing input to the microprocessor.

8. A directional control system as claimed in claim 1, wherein the at least one mass-shifting device is a solenoid-actuated device positioned off the central longitudinal axis of the projectile.

9. A directional control system as claimed in claim 8, wherein every solenoid-actuated device includes two solenoids positioned to reversibly move the mass from the first position to the second position.

10. A directional control system as claimed in claim 1, wherein the at least one mass-shifting device comprises a swash plate centered about the central longitudinal axis of the projectile.

11. A directional control system as claimed in claim 10, wherein the mass-shifting device is a magnet and coil.

12. A directional control system as claimed in claim 10, wherein the mass-shifting device is a solenoid device.

13. A directional control system as claimed in claim 1, wherein the device capable of sensing and identifying a preferred target direction comprises a plurality of optical fibers for receiving radiation emanating from the target.

14. A directional control system as claimed in claim 1, wherein the device capable of sensing and identifying a preferred target direction is sensitive to radio frequency radiation, and includes at least one antenna sensitive to radio frequency radiation emanating from the target.

15. A directional control system as claimed in claim 14, wherein the device capable of sensing and identifying a preferred target direction includes two antennae sensitive to radio frequency radiation.

16. A directional control system as claimed in claim 1, wherein the device capable of sensing and identifying a preferred target direction includes at least one infrared detector sensitive to infrared radiation emanating from the target.

17. A directional control system as claimed in claim 1, wherein the device capable of sensing and identifying a preferred target direction comprises an inertial navigation system.

18. A directional control system as claimed in claim 1, wherein the device capable of sensing and identifying a preferred target direction comprises a global positioning system.

19. A directional control system for spinning ballistic projectiles, comprising:

a projectile, wherein the projectile has no externally protruding bodies, the projectile having a rotation axis and rotating about the rotation axis at a rotation rate;

a device within the projectile capable of sensing and identifying a preferred target direction relative to the projectile, a moveable mass located within the projectile, at least one electromagnet-magnet driver mass-shifting device within the projectile capable of reversibly moving the mass from a first position to a second position, wherein the mass-shifting device includes two mass-shifting subdevices, the two subdevices are aligned such that the mass can be reversibly moved between the two subdevices from the first position to the second position, the moveable mass rotationally fixed relative to the projectile when engaged in either the first position or the second position, wherein the system includes at least one microprocessor programmed to obtain input from the sensing and identifying device and to perform calculations to determine movements of the mass, and whereby the flight path of the projectile is controlled for movement toward a target.

20. A directional control system as claimed in claim 19, wherein the at least one mass-shifting device is a solenoid-actuated device positioned off the central longitudinal axis of the projectile.

21. A directional control system as claimed in claim 20, wherein every solenoid-actuated device includes two solenoids positioned to reversibly move the mass from the first position to the second position.

22. A directional control system as claimed in claim 19, wherein the at least one mass-shifting device comprises a swash plate centered about the central longitudinal axis of the projectile.

23. A directional control system as claimed in claim 22, wherein the mass-shifting device is a magnet and coil.

24. A directional control system as claimed in claim 22, wherein the mass-shifting device is a solenoid device.

25. A directional control system as claimed in claim 19, wherein the device capable of sensing and identifying a preferred target direction is sensitive to radio frequency radiation, and includes at least one antenna sensitive to radio frequency radiation emanating from the target.

26. A directional control system as claimed in claim 25, wherein the device capable of sensing and identifying a preferred target direction includes two antennae sensitive to radio frequency radiation.

27. A directional control system as claimed in claim 19, wherein the device capable of sensing and identifying a preferred target direction includes at least one infrared detector sensitive to infrared radiation emanating from the target.

28. A directional control system as claimed in claim 19, wherein the device capable of sensing and identifying a preferred target direction comprises an inertial navigation system.

29. A directional control system as claimed in claim 19, wherein the device capable of sensing and identifying a preferred target direction comprises a global positioning system.

30. A directional control system as claimed in claim 19, wherein the device capable of sensing and identifying a preferred target direction comprises a plurality of optical fibers for receiving radiation emanating from the target.

31. A directional control system as claimed in claim 19, wherein the system includes at least one accelerometer within the projectile, for providing input to the microprocessor.

32. A directional control system as claimed in claim 31, wherein the system includes two accelerometers within the projectile.

33. A directional control system as claimed in claim 19, wherein the system includes at least one pressure sensor within the projectile, for providing input to the microprocessor.

34. A method for controlling the flight path of spinning ballistic projectiles for movement toward a target, comprising:

launching a projectile toward a target, the launched projectile having a rotation axis and rotating about the rotation axis at a rotation rate;

sensing and identifying a preferred target direction by means including a device within the projectile capable of sensing and identifying a preferred target direction; and reversibly moving a moveable mass from a first position to a second position within the projectile by means of at least one electromagnet-magnet driver mass-shifting device within the projectile, the moveable mass rotationally fixed relative to the projectile when engaged in either the first position or the second position.

35. A method as claimed in claim 34, wherein the step of launching further comprises launching a projectile having no externally protruding bodies.

36. A method as claimed in claim 34, wherein the method includes a step in which a microprocessor receives input from the tracking device and calculates movements of the mass.

37. A method as claimed in claim 36, wherein the step of receiving input from the tracking device and calculating movements of the mass is performed by two microprocessors.

38. A method as claimed in claim 34, wherein the step of moving a moveable mass is performed on a mass located off the central longitudinal axis of the projectile.

39. A method as claimed in claim 38, wherein the step of reversibly moving a moveable mass is performed by a mass-shifting device that is solenoid-actuated.

40. A method as claimed in claim 34, wherein the step of moving a moveable mass is performed on a mass centered on the central longitudinal axis of the projectile.

41. A method as claimed in claim 40, wherein the step of reversibly moving a moveable mass is performed by a mass-shifting device that is solenoid-actuated.

42. A method as claimed in claim 40, wherein the step of reversibly moving a moveable mass is performed by a mass-shifting device comprising a magnet and coil.

43. A method as claimed in claim 34, wherein the step of reversibly moving a moveable mass is performed by a mass-shifting device comprising two solenoids.

44. A method as claimed in claim 43, wherein the step of reversibly moving a moveable mass is performed by a mass-shifting device comprising two solenoids positioned to reversibly move the mass from the first position to the second position.

45. A method as claimed in claim 34, wherein the step of sensing includes sensing electromagnetic radiation in the region from visible to far infrared radiation, and uses a plurality of optical fibers for receiving radiation emanating from the target.

46. A method as claimed in claim 34, wherein the step of sensing includes sensing radio frequency radiation, and the projectile includes at least one antenna sensitive to radio frequency radiation emanating from the target.

47. A method as claimed in claim 46, wherein the steps of sensing further includes two antennae sensitive to radio frequency radiation.

48. A method as claimed in claim 34, wherein the step of sensing includes using at least one infrared detector sensitive to infrared radiation emanating from the target.

49. A method as claimed in claim 34, wherein the step of sensing includes using an inertial navigation system.

50. A method as claimed in claim 34, wherein the step of sensing includes using a global positioning system.

51. A method as claimed in claim 34, wherein the step of sensing includes measuring an acceleration using at least one accelerometer within the projectile.

52. A method as claimed in claim 51, wherein the step of sensing includes measuring two accelerations using two accelerometers within the projectile.

53. A method as claimed in claim 34, wherein the step of sensing includes sensing pressure using a sensor within the projectile.

* * * * *